US007975621B2

(12) United States Patent
Gibson

(10) Patent No.: US 7,975,621 B2
(45) Date of Patent: Jul. 12, 2011

(54) RAIL FIREFIGHTING PLATFORM

(76) Inventor: Don Gibson, Knoxville, TN (US)

( * ) Notice: Subject to any disclaimer, the term of this patent is extended or adjusted under 35 U.S.C. 154(b) by 337 days.

(21) Appl. No.: 12/247,390

(22) Filed: Oct. 8, 2008

(65) Prior Publication Data

US 2010/0083868 A1 Apr. 8, 2010

(51) Int. Cl.
*A62C 3/07* (2006.01)

(52) U.S. Cl. ..... 105/238.1; 105/463.1; 169/62; 169/67

(58) Field of Classification Search ..... 105/358, 105/463.1, 238.1; 169/13, 24, 54, 55, 62, 169/64, 66, 67; 239/173, 174, 195; 280/4, 280/7; 296/24.3
See application file for complete search history.

(56) References Cited

U.S. PATENT DOCUMENTS

| | | | | |
|---|---|---|---|---|
| 589,244 | A * | 8/1897 | Cantore | 169/47 |
| 596,669 | A * | 1/1898 | Twining | 239/168 |
| 5,240,078 | A * | 8/1993 | Worthington | 169/47 |
| 6,213,515 | B1 * | 4/2001 | La Terra | 280/834 |
| 2004/0050557 | A1 * | 3/2004 | Koopmann | 169/24 |
| 2004/0066052 | A1 * | 4/2004 | Payne | 296/32 |
| 2006/0260824 | A1 * | 11/2006 | Dillman | 169/46 |
| 2008/0217443 | A1 * | 9/2008 | Zacherl et al. | 239/722 |
| 2010/0038100 | A1 * | 2/2010 | Schuetzle | 169/52 |

* cited by examiner

*Primary Examiner* — S. Joseph Morano
*Assistant Examiner* — Zachary Kuhfuss
(74) *Attorney, Agent, or Firm* — Pitts & Brittian, P.C.

(57) ABSTRACT

An apparatus for fighting fires comprises a rail carriage, a base mounted upon the rail carriage and an enclosure mounted upon the base. The enclosure includes a top wall having an aperture defined therein. At least one vertically extendible lift is mounted within the enclosure and carries a liquid discharging device. A pressurizer and connecting conduits deliver liquid from a liquid source to the liquid discharging device.

7 Claims, 3 Drawing Sheets

RAIL FIREFIGHTING PLATFORM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention relates to fire-fighting equipment. More particularly, the present invention relates to a rail-based apparatus for fighting fires in remote areas.

2. Description of the Related Art

Forest fires frequently occur in remote forested areas which are often relatively inaccessible by roads. Accordingly, firefighters and equipment are often flown into these remote areas by helicopter or the firefighters must hike through heavily overgrown terrain to reach the remote areas.

Water and chemical retardants are the most common fire fighting "tools." Unfortunately, in remote forested areas, frequently the only source of water and chemical retardants is by aircraft, either planes or helicopters. In the midst of forest fires, such flights are quite dangerous and expensive.

An alternative means for accessing the remote areas is to use rail lines which have been built to reach through heavily forested areas, either to be used in logging activities or to achieve the most direct routes. There are many miles of rail extending through heavily forested areas and usable to reach forest fires.

BRIEF DESCRIPTION OF THE INVENTION

The present invention provides an apparatus for transporting firefighters, water and equipment into remote, forested areas by rail. In addition, the present invention provides equipment for applying water and/or chemical retardants to extended areas adjacent to rail lines.

According to one embodiment of the present invention, in accordance with the present invention, a rail car includes a base upon which is mounted an enclosure having side walls and a top wall. Connectors are provided at each end of the rail car for connecting the rail car directly or indirectly to an engine and a tanker car. An entry door is provided in at least one of the side walls. A door is provided in the top wall of the enclosure.

Within the enclosure a platform is mounted upon a lift below the door in the top wall. The platform carries a rotatable water-cannon, which is connected by a hose to a pump, which is serially connected by a hose to a source of water, such as a tank car or a body of water. Also contained within the enclosure are an electrical generator and a safe room.

When the door in the top wall is opened, the platform is vertically extendible upwardly through the top wall to allow a firefighter to apply water or liquid chemical retardant over an extended area around the rail car, even as the car is moving through a forested area.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
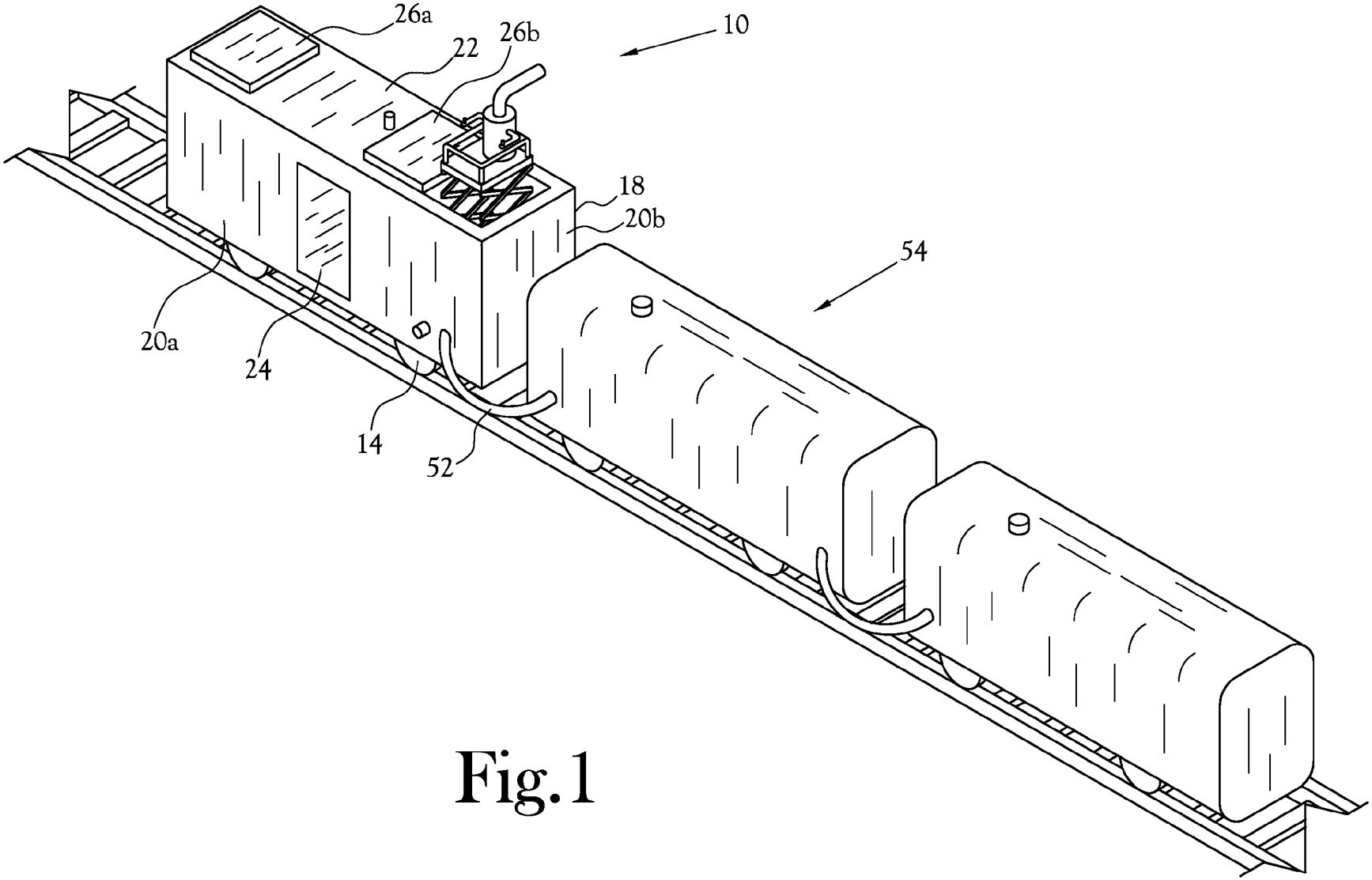
FIG. 1 is a perspective view of an apparatus in accordance with the present invention.
Figure 2:
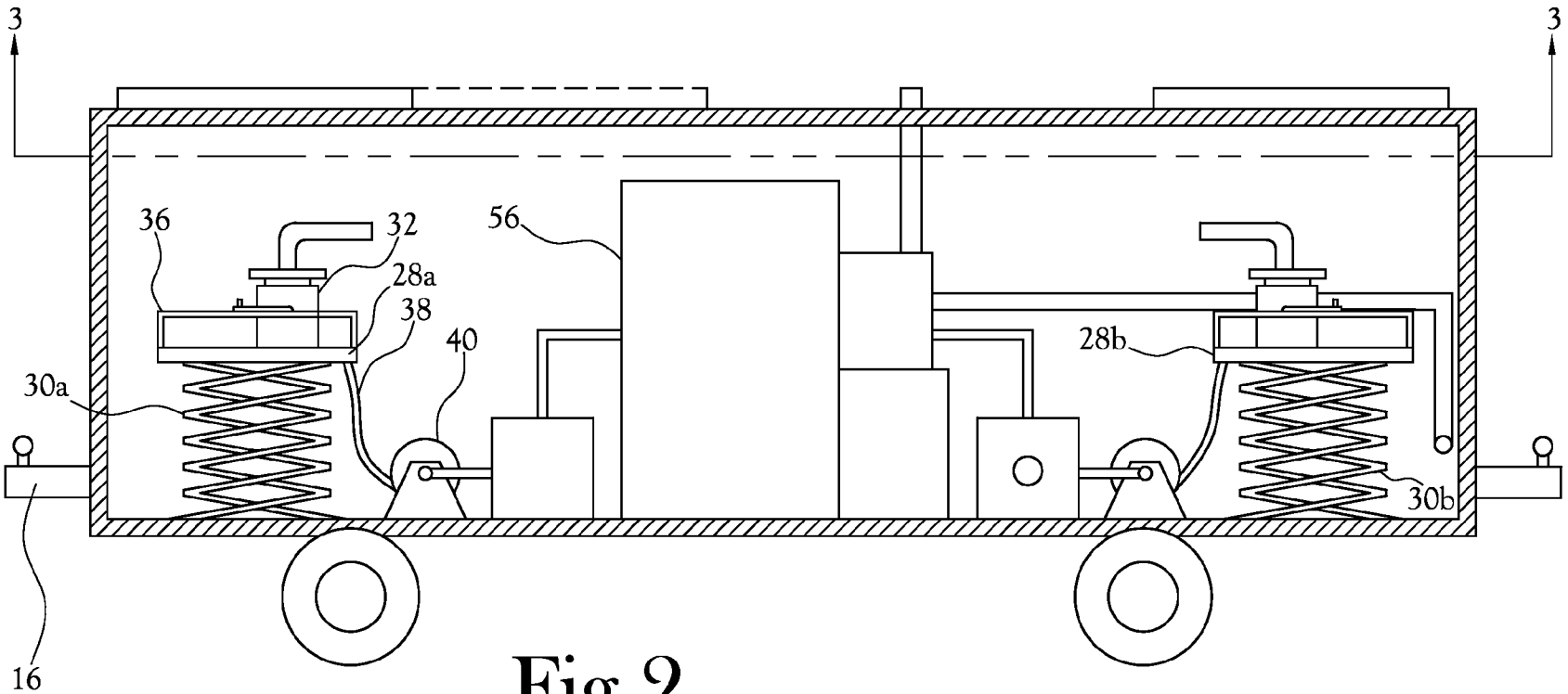
FIG. 2 is cutaway elevation view of an apparatus in accordance with the present invention.
Figure 3:
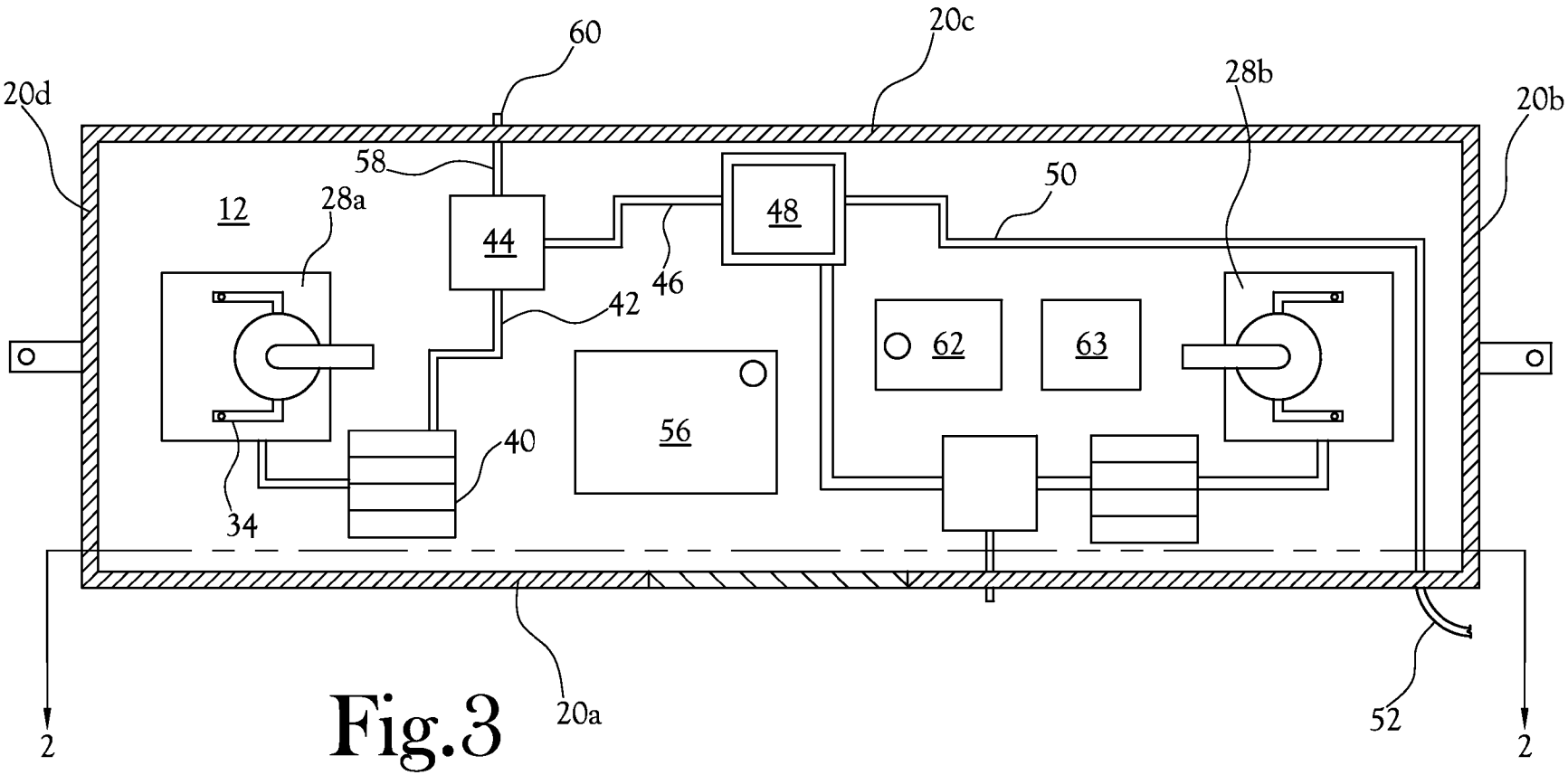
FIG. 3 is a plan view of the apparatus of FIG. 2.

Referring to the drawings, in which similarly numbered parts refer to similar parts in the various drawings, a firefighting rail car 10 is disclosed. The rail car 10 includes a base 12 mounted upon a carriage with wheels 14 and connectors 16 at each end of the carriage. An enclosure 18 is mounted upon the base 12. The enclosure 18 is defined by a plurality of side walls 20*a*, 20*b*, 20*c* and 20*d* and a top wall 22. An access door 24 is provided in the side wall 20*a* to provide egress to the interior of the enclosure 18 and protection from the elements when it is closed. Two sliding doors 26*a* and 26*b* are mounted in the top wall 22. The side walls 20*a*, 20*b*, 20*c* and 20*d* and the top wall 22 are constructed of non-flammable materials, such as steel, and are internally insulated to provide resistance to extreme temperatures within the enclosure 18.

Within the enclosure 18, two platforms 28*a* and 28*b* are mounted upon vertically extendible lifts 30*a* and 30*b*, respectively, for elevating the platforms 28*a* and 28*b* above the top wall 22 when the doors 26*a* and 26*b* are open. In the depicted embodiment, the lifts 30*a* and 30*b* comprise scissor lifts, but it will be recognized by those skilled in the art that alternative lift mechanisms may be provided.

On each of the platforms 28*a* and 28*b*, only one of which will be described in detail, a rotatable water-cannon 32 is mounted to discharge liquid. The water-cannon 32 includes a handle 34 for effecting rotation of the water-cannon 32 and vales to control liquid flow through the water-cannon. A protective rail 36 surrounds the water-cannon 32 to provide additional support for an operator of the water-cannon 32.

The water-cannon 32 is supplied with liquid, such as water or fire retardant through a hose 38 carried on a retractable reel 40. Accordingly, as the platforms 28*a* and 28*b* are raised and lowered through the doors 26*a* and 26*b*, respectively, the hose 38 is uncoiled and coiled upon the retractable reel 40. A conduit 42 provides flow communication between the hose 38 and the pump 44.

A conduit 46 provides liquid flow communication to the pump 44 from a holding tank 48. A conduit 50 provides liquid flow communication to the feed tank 48 from a flexible hose 52, which extends outwardly from the side wall 20*a*. The flexible hose 52 is preferably fireproof and provides liquid flow communication from a liquid source, such as a tank car 54 or a natural body of water.

A conduit 58 provides liquid flow communication from the pump 44 to a spigot 60 located on the outer surface of the side wall 20*c*. As desired, a hose may be connected to the spigot 60 and supplied with pressurized liquid from the pump 44.

A diesel-powered electrical generator 62 is located within the enclosure 18 to provide electrical power for the pump 44, the lifts 30*a* and 30*b*, as well other electrical devices within the enclosure. The generator 62 is vented to the outside atmosphere and is provided with a fresh air intake. An insulated diesel fuel tank 63 is provided Suitable electrical connections, known in the art, provide electrical power from the generator to the various equipment. Alternatively, electrical power may be provided from a train engine generator.

Also located within the enclosure 18 is a sealable safe room 56. The safe room 56 is heavily insulated and provided with suitable respiration equipment to accommodate the firefighting crew in the event that the rail car 10 is overtaken by fire. The safe room may also contain communications equipment and GPS equipment.

In operation of one embodiment of the present invention, the tanker car 54 is full of water. The rail car 10 and the tanker car 54 are transported by rail to a location threatened by fire. At the threatened location, the door 26*b* is opened and a firefighter rides upon the platform 28*b* as the lift 30*b* extends vertically upward through the open door 26*b*. The pump 44 draws water from the tank car 54 through the hose 52, the conduit 50, the feed tank 48, and the conduit 46. The water is directed through the conduit 42 and the hose 38 to the water cannon 32. The firefighter activates the water cannon 32 and directs the water throughout the surrounding threatened area.

In the alternative, a firefighter may connect a hose to the spigot 60 and receive water through the conduit 58 to apply water to the ground area adjacent to the rail car 10, which may be out of range of the water cannon 32.

From the foregoing description, it will be recognized by those skilled in the art that an improved firefighting apparatus has been provided.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for fighting fires, said apparatus comprising:

a rail carriage;

a base mounted upon said rail carriage;

an enclosure mounted upon said base and including side walls, a front wall, a rear wall and a top wall having an aperture defined therein;

at least one vertically extendible lift mounted within said enclosure and carrying a liquid discharging device capable of being extended through said aperture; and a pressurizer and conduits for delivering liquid from a liquid source to said liquid discharging device.

2. The apparatus of claim 1 further including a safe room.

3. The apparatus of claim 1 further including an electrical generator.

4. The apparatus of claim 1 wherein said liquid discharging device comprises a rotatable water cannon.

5. The apparatus of claim 1 wherein said liquid source comprises a rail-mounted tanker car.

6. The apparatus of claim 1 wherein said liquid source comprises a natural body of water.

7. The apparatus of claim 1 wherein said conduits comprise a flexible hose mounted upon a reel.

* * * * *